United States Patent [19]

Burgei et al.

[11] Patent Number: 5,050,270

[45] Date of Patent: Sep. 24, 1991

[54] HINGE FOR AN AUTOMOBILE TRUNK LID

[75] Inventors: Russell J. Burgei; Lavern R. McCallips; Teddy B. Johnson, all of Rockford, Ill.

[73] Assignee: Atwood Industries, Inc., Rockford, Ill.

[21] Appl. No.: 567,749

[22] Filed: Aug. 15, 1990

[51] Int. Cl.[5] ..... E05F 1/12

[52] U.S. Cl. ..... 16/298; 16/306; 16/358; 16/360; 16/361

[58] Field of Search ..... 16/298, 306, 307, 308, 16/358, 360, 361, 368, 16; 180/69.21; 296/76

[56] References Cited

U.S. PATENT DOCUMENTS

| | | | |
|---|---|---|---|
| 1,832,174 | 11/1931 | Zahner et al. | 16/358 |
| 2,124,893 | 7/1983 | Peppas | 16/306 |
| 2,272,230 | 2/1942 | Voorhees | 16/306 |
| 2,702,401 | 2/1955 | Vigmoshad et al. | 296/76 |
| 4,530,412 | 7/1985 | Sigety, Jr. | 180/69.21 |
| 4,768,762 | 9/1988 | Lund | 16/1 C |

*Primary Examiner*—Richard K. Seidel
*Assistant Examiner*—Edward A. Brown
*Attorney, Agent, or Firm*—Leydig, Voit & Mayer

[57] ABSTRACT

An automobile trunk lid is mounted for swinging on the automobile body between closed and open positions with respect to the trunk compartment. Each hinge includes a slotted hinge arm attached to the underside of the lid and a slotted body bracket attached to the body adjacent one side of the trunk compartment. A follower on the hinge arm projects into and is adapted to travel along the slot in the body bracket while a follower on the body bracket projects into the slot in the hinge arm. As the lid is opened, the followers and slots coact to first elevate the forward portion of the lid away from the body and then to allow the lid to swing open about an instantaneously changing axis. A spring, a cam and a cable coact to apply a spring-assist to the lid during opening, the cam and cable acting to compensate for the spring rate of the spring as the lid moves and its center of gravity changes in space.

6 Claims, 3 Drawing Sheets

HINGE FOR AN AUTOMOBILE TRUNK LID

BACKGROUND OF THE INVENTION

This invention relates generally to a hinge and, more particularly, to a hinge for mounting the trunk lid of an automobile for swinging upwardly and downwardly on the vehicle body from a normally closed position to an open position with respect to the trunk compartment of the automobile.

It is desirable for the forward edge of a trunk lid to be located closely adjacent the shelf at the rear window of the automobile in order to increase luggage space. When the trunk lid is so located, the lid must be connected to the body by hinges which enable the lid to quickly move clear of the shelf when the lid is swung upwardly. Conventionally, such hinges include long gooseneck-like arms which, when the lid is closed, are located in the trunk compartment with the forward end portions of the arms located beneath the shelf. Gooseneck arms occupy considerable space in the trunk compartment and significantly reduce its effective capacity.

SUMMARY OF THE INVENTION

The general aim of the present invention is to provide a new and improved hinge which allows the trunk lid to swing open in a manner similar to that permitted by a gooseneck hinge but which occupies significantly less space in the trunk compartment.

A more detailed object of the invention is to achieve the foregoing through the provision of a hinge having a hinge arm which fits compactly in the trunk compartment and which, rather than swinging about a single axis of rotation, swings about instantaneously changing axes so as to enable the lid to elevate and clear the rear shelf.

Still another object of the invention is to provide a hinge which enables the lid to be lifted with relatively low effort and which compensates for changes in the center of gravity of the lid as the lid moves from a fully closed position to a fully open position.

In a more detailed sense, the invention resides in the provision of a hinge in which a cable is drawn around a cam as the lid is opened and compensates for the spring rate of a spring which assists in opening the lid.

These and other objects and advantages of the invention will become more apparent from the following detailed description when taken in conjunction with the accompanying drawings.

DETAILED DESCRIPTION OF THE PREFERRED EMBODIMENT

Figures 1, 2:
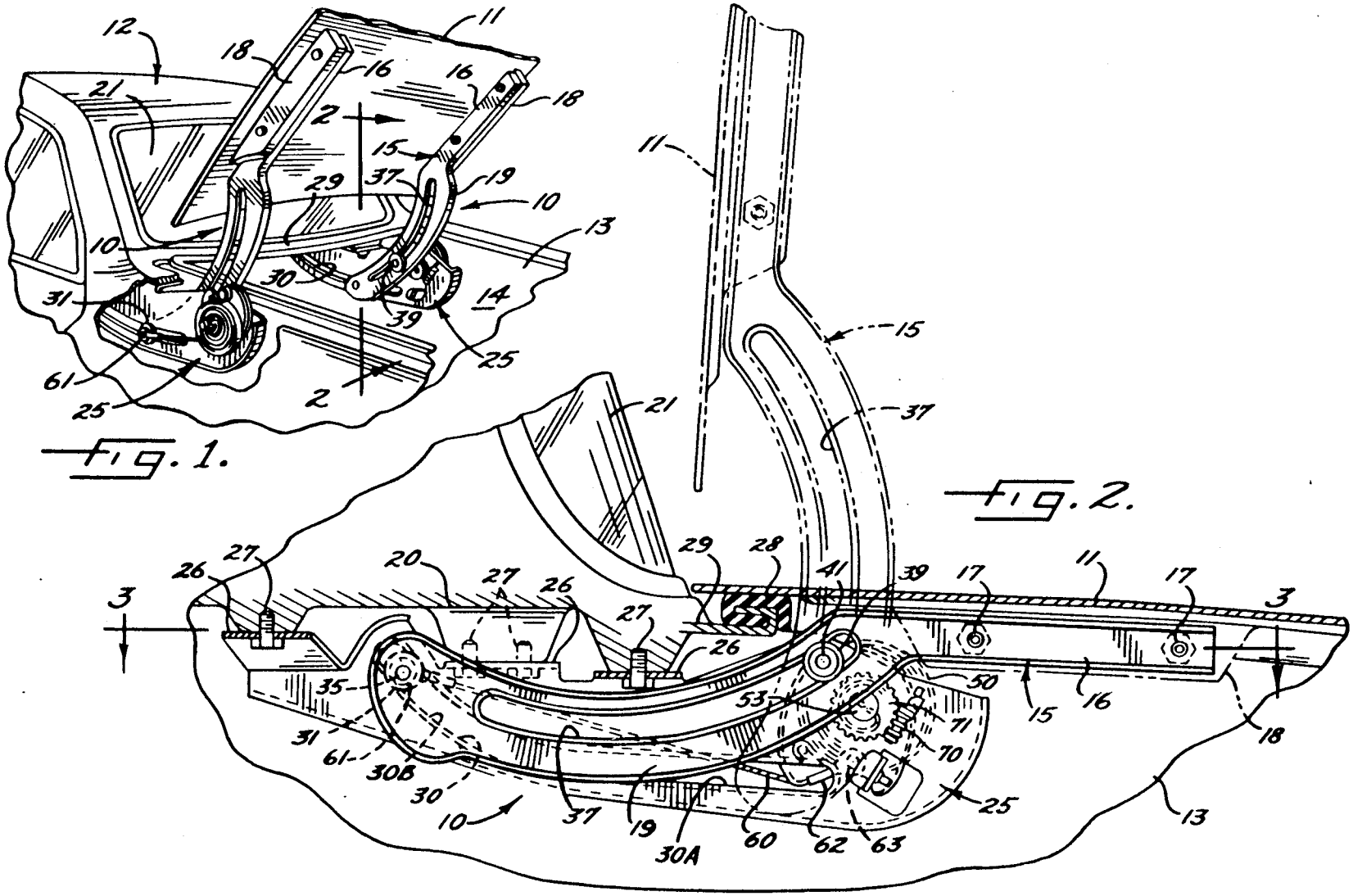
FIG. 1 is a fragmentary perspective view of a typical automobile equipped with a pair of new and improved trunk lid hinges incorporating the unique features of the present invention.
FIG. 2 is an enlarged fragmentary cross-section taken substantially along the line 2—2 of FIG. 1 and shows the trunk lid in its fully closed position.

For purposes of illustration, the invention has been shown in the drawings as incorporated in hinges 10 for supporting the trunk lid 11 of an automobile 12 on the body 13 thereof for swinging between closed and open positions with respect to the trunk compartment 14. A hinge 10 is located adjacent each side edge portion of the lid 11. The two hinges are identical except that one is a left-hand hinge while the other is a right-hand hinge. Only the right-hand hinge has been shown in detail and only that hinge will be described since the other hinge is the same other than for the difference in hand.

The hinge 10 includes an elongated arm 15 having a straight rear portion 16 which is adapted to be anchored rigidly by screws 17 to a mounting bracket 18 on the underside of the lid 11 adjacent the side edge portion thereof. The forward portion 19 of the arm 15 is bowed upwardly and, when the lid is fully closed, is partially located beneath the shelf 20 adjacent the rear window 21 of the vehicle 12.

In addition, the hinge 10 includes a plate-like body bracket 25 adapted to be attached to the body 13 within the trunk compartment 14 and closely adjacent the side thereof. As shown most clearly in FIG. 3, the upper portion of the body bracket 25 is formed with three upwardly facing mounting flanges 26 which receive screws 27 for anchoring the bracket to the body 13. The major length of the body bracket is located beneath the shelf 20.

When the lid 11 is fully closed, its forward edge portion overlies and seals against a gasket 28 (FIG. 2) located on a body plate 29 which extends rearwardly from the window 21. In order to permit opening of the lid, it is necessary that the forward edge portion of the lid elevate away from the gasket before the lid undertakes any significant swinging motion. In the past, the lid has been mounted on long gooseneck-like hinge arms which permit elevation of the forward edge portion of the lid. When the lid is fully closed, however, the long gooseneck hinge arms project downwardly a significant distance into the trunk compartment 14 and interfere with full utilization of the space therein.

In accordance with the present invention, the hinge 10 is constructed in a unique manner such that the hinge arm 15 does not swing about a fixed pivot axis but instead moves about multiple axes which instantaneously change in space as the lid 11 is moved between its fully closed and fully open positions. Moreover, easy opening of the lid is facilitated by a spring assist which uniquely takes into account the changing center of gravity of the lid and allows the lid to be opened with relatively little manual effort.

More specifically, the foregoing is achieved by forming an elongated and generally longitudinally extending slot 30 (FIG. 9) through the body bracket 25. The rear portion 30A of the slot is generally straight and horizontal while the forward portion 30B of the slot gradually curves upwardly. Received in and adapted to travel along the slot 30 is a follower or roller 31 which herein is in the form of a roller bearing having a plastic tire which engages the edges of the slot. The roller 31 is journaled on a pin 35 which is fixed to the hinge arm 15. When the lid 11 is fully closed, the roller is located adjacent the extreme forward end of the slot 30. As the lid is opened, the roller travels rearwardly along the slot and stops just short of the rear end of the slot when the lid is fully open.

Figures 7, 8, 9, 10:
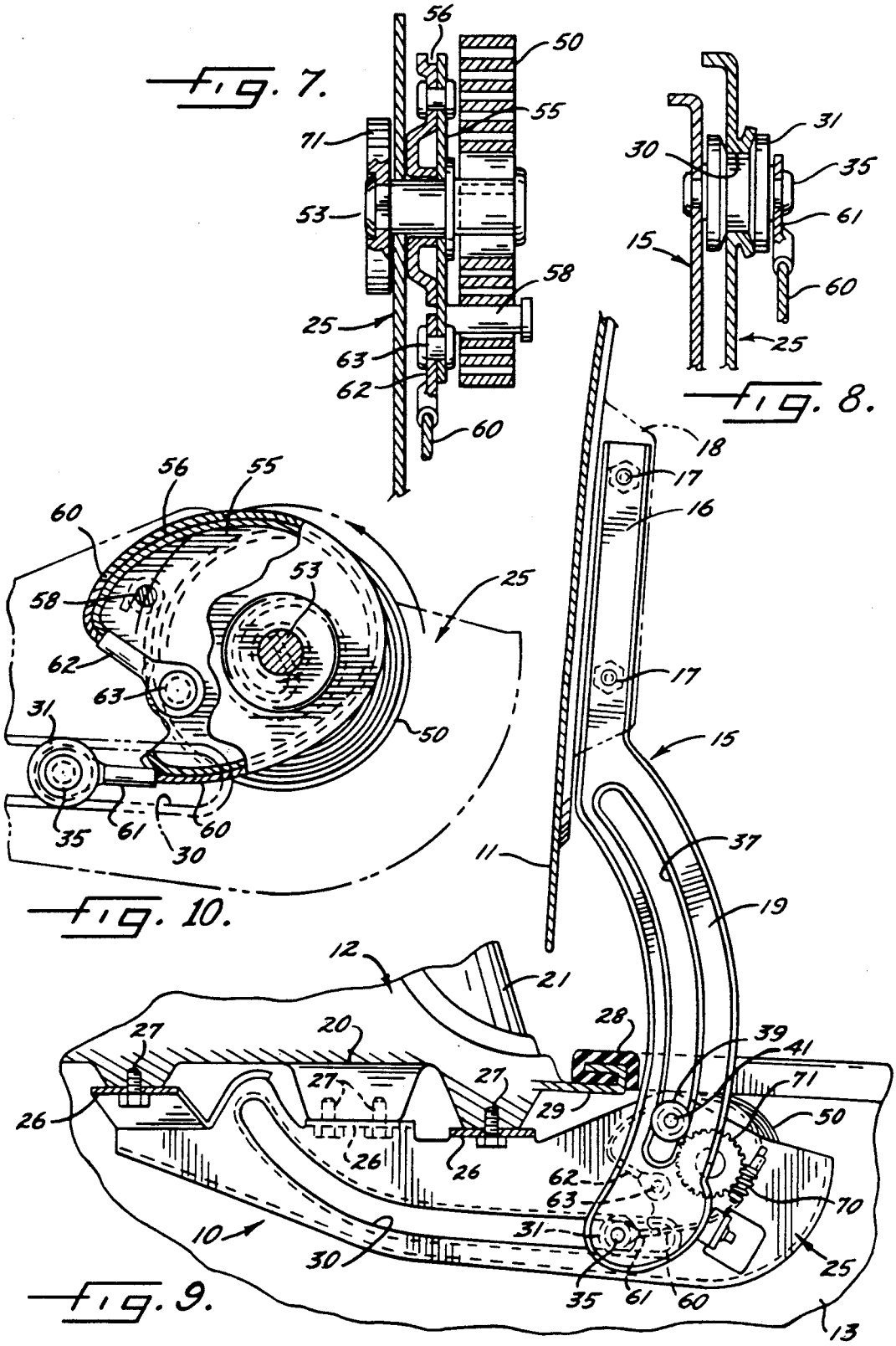
FIG. 9 is a view similar to FIG. 2 but shows the trunk lid in its fully open position.
FIG. 10 is a view similar to FIG. 5 but shows certain components of the hinge when the trunk lid is in its fully open position.

A slot 37 also is formed through the curved portion 19 of the hinge arm 15, the slot being curved along its full length. When the lid 11 is fully closed, the lower side of the slot 37 defines a concave and upwardly facing edge while the upper side of the slot defines a convex and downwardly facing edge. The slot 37 is adapted to receive a follower 39 which preferably takes the form of a roller similar to the roller 31. The roller 39 is journaled on a pin 41 (FIG. 3) which, in turn, is fixed rigidly to the body bracket 25. When the lid 11 is fully closed, the extreme rear end of the slot 37 is located adjacent the roller 39 as shown in solid lines in FIG. 2. The edges of the slot 37 ride along the roller 39 as the lid is opened and, when the lid is fully open, the forward end portion of the slot is located adjacent the roller as shown in FIG. 9.

Thus, the hinge arm 15 carries a roller 31 which rides along and is guided by the slot 30 in the body bracket 25 while the body bracket supports a roller 39 which fits into the slot 37 in the hinge arm so as to provide a further guide for the arm. By virtue of the shapes and locations of the slots, the lid 11, upon being opened, first elevates away from the gasket 28 and then swings to the position shown in FIG. 9. In this particular instance, the lid rotates through approximately 88 degrees from its fully closed position to its fully open position.

Figure 3:
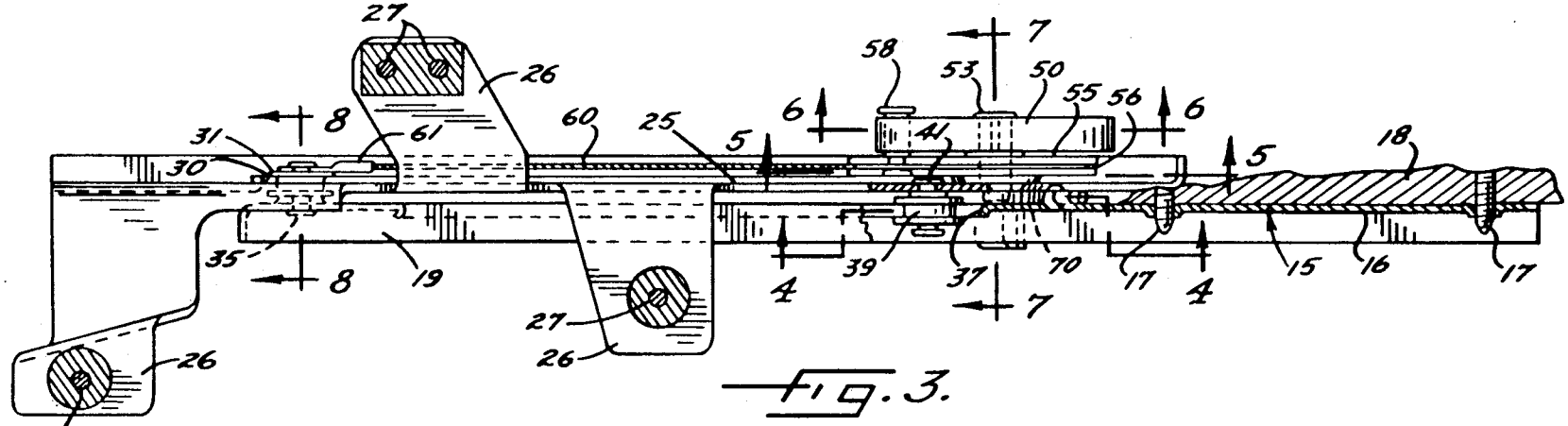
FIG. 3 is an enlarged fragmentary cross-section taken substantially along the line 3—3 of FIG. 2.

As shown most clearly in FIGS. 2 and 3, the hinge arm 15 and the body bracket 25 lie in closely spaced side-by-side relation when the lid 11 is fully closed and are located closely adjacent the side of the trunk compartment 14. Also, the arm and bracket project downwardly into the trunk compartment only a relatively short distance. Thus, the hinge 10 occupies a comparatively small amount of space so as to enable a larger volume of space to be used for storage purposes.

A spring 50 preferably is associated with the hinge 10 to assist in lifting the lid 11 to its open position and thereby reduce the manual effort involved in opening the lid. Pursuant to the invention, provision is made to compensate for the spring rate of the spring as the lid opens and its center of gravity assumes different positions in space. As a result, the lid may be opened with reasonable effort from any given position.

Figure 6:
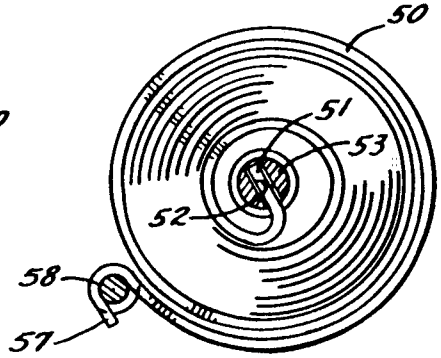
FIGS. 4, 5, 6, 7 and 8 are enlarged fragmentary cross-sections taken substantially along the lines 4—4, 5—5, 6—6, 7—7 and 8—8, respectively, of FIG. 3.

More specifically, the spring 50 is formed by a spirally wound strip of spring steel and is formed with an inner tang 51 (FIG. 6) which is anchored in a slot 52 in a pivot pin 53. The latter, in turn, is supported by and projects laterally from the body bracket 25. Supported to rotate on the pin 53 is a cam 55 having a circumferentially grooved peripheral surface 56 which is eccentric with respect to the axis of the pin. The outer end portion of the spring 50 is formed with a bent tang 57 (FIG. 6) which is hooked around a laterally projecting stud 58, the latter being rigidly fastened to the cam. Thus, one end 51 of the spring 50 is fixed while the other end 57 is adapted to rotate with the cam 55.

The spring 50 is wound in such a direction as to tend to turn the cam 55 counterclockwise. To transfer the force of the spring to the lid 11, provision is made of an elongated flexible element such as a steel cable 60 having eyes 61 and 62 at its forward and rear ends, respectively. The eye 61 is connected to the mounting pin 35 for the roller 31 while the eye 62 is connected to a rivet 63 which is rigid with the cam 55 in radially offset relation from the rotational axis thereof.

Figure 5:
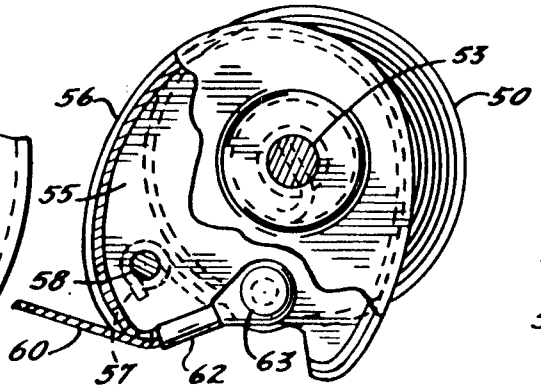

When the lid 11 is fully closed, the cable 60 is fully tensioned between the pin 35 and the rivet 63 and holds the cam 55 in a rotationally fixed position with the spring 50 in a fully wound condition. The extreme rear end portion of the cable is received in the grooved periphery 56 of the cam as shown in FIG. 5.

When the trunk lid 11 is unlocked and released to move from its closed position, the spring 50 starts to unwind and turns the cam 55 counterclockwise. As the cam turns, it pulls on the cable 60 and thus transmits the spring force to the hinge arm 15 via the pin 35. Such force causes the roller 39 to move rearwardly in the slot 30 and thus acts to open the lid. As the lid opens and the cam continues to turn, the cable is wrapped progressively around the periphery 56 of the cam as shown in FIG. 10. As a result, the force applied to the hinge arm 15 is modified as the center of gravity of the lid 11 moves in space and as the spring 50 unwinds and exerts less torque on the cam 55. By virtue of the cable wrapping around the cam, the force applied to the lid is programmed rather than being controlled solely by the spring rate of the spring. Thus, by using a particular design of cam with a given design of lid, proper opening characteristics may be achieved. In this particular instance, the cam rotates through about 310 degrees as the lid moves from fully closed to fully open.

Figure 4:
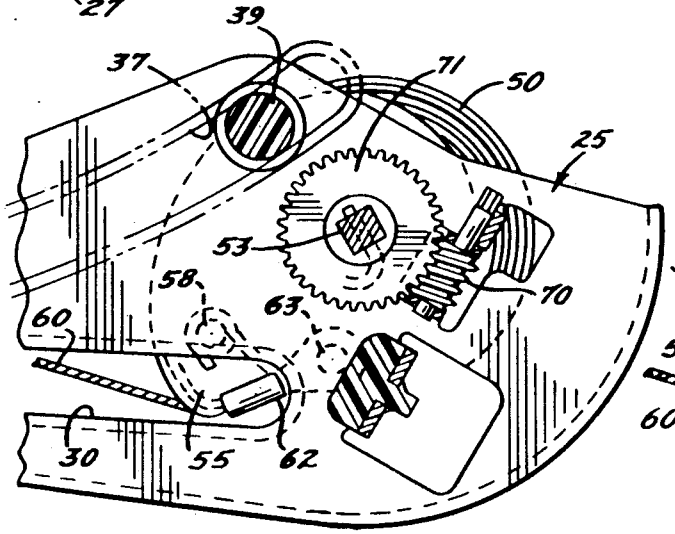

Means are provided for establishing the initial preload on the spring 50 when the lid is fully open. Herein, these means comprise a worm 70 (FIG. 4) rotatably supported by the body bracket 25 and meshing with a worm gear 71 which is fastened to the pivot pin 53 of the cam 55, the pivot pin being supported to turn by the body bracket 25. By turning the worm, the initial angular position of the pin 53 may be changed in order to set the initial preload on the spring 50. Since the worm-/worm gear drive is non-reversible, the pin 53 is held in a fixed angular position once manual turning of the worm is terminated. It is contemplated that the worm-/worm gear drive will be adjusted only at the automobile assembly plant and will not require further adjustment during the service life of the automobile. The adjustment is infinite in nature and thus enables the spring preload to be set at a precisely established value.

From the foregoing, it will be apparent that the present invention brings to the art a new and improved trunk lid hinge 10 which allows proper movement of the lid 11 while taking up comparatively little space in the trunk compartment 14. The spring 50, the cam 55 and the cable 60 coact in a unique manner to compensate for the spring rate of the spring and to modify the force applied to the lid as the latter is opened and its center of gravity changes in space. The worm 70 and worm gear 71 enable the initial preload on the spring to be precisely established in order to effect opening of the lid in a desired manner.

We claim:

1. A hinge for mounting the rear trunk lid of a vehicle for swinging upwardly on a vehicle body from a normally closed position to an open position relative to a trunk compartment, said hinge comprising a bracket adapted to be attached to said body within said compartment, an arm adapted to be attached to the underside of said lid, and means interconnecting said arm and said bracket and supporting said arm to move relative to said bracket to permit swinging of said lid between said closed and open positions, said means comprising a first elongated slot formed in said bracket, a first follower attached to said arm and received in said first slot to move back and forth therealong, a second elongated slot formed in said arm, a second follower attached to said bracket and received in said second slot to help guide said arm as said lid is moved between said closed and open positions, said first slot having a substantially straight and substantially horizontal rear portion and having an upwardly curved forward portion, said second slot having a concavely curved lower edge which faces upwardly when said lid is in said closed position and having a convexly curved upper edge which faces downwardly when said lid is in said closed position, said curved edges riding along said second follower as said lid is moved between said closed and open positions.

2. A hinge as defined in claim 1 further including a cam mounted on said bracket to rotate about a predetermined axis and having a peripheral surface, a spring connected between said bracket and said cam and loaded to bias said cam in a first direction about said axis when said lid is in said closed position, an elongated flexible element having one end connected to said first follower and having an opposite end connected to said cam at a point spaced radially from said axis, said flexible element preventing said cam from being rotated in said first direction by said spring when said lid is in said closed position and wrapping around the peripheral surface of said cam when the cam rotates in said first direction as said lid is released from said closed position for movement toward said open position.

3. A hinge as defined in claim 2 further including means for selectively adjusting the load on said spring.

4. A hinge for mounting the trunk lid of a vehicle for swinging upwardly on a vehicle body from a normally closed position to an open position relative to a trunk compartment, said hinge comprising a bracket adapted to be attached to said body within said compartment, an arm adapted to be attached to the underside of said lid, and means interconnecting said arm and said bracket and supporting said arm to move relative to said bracket to permit swinging of said lid between said closed and open positions, said means comprising a first elongated slot formed in said bracket, a first follower attached to said arm and received in said first slot to move back and forth therealong, a second elongated slot formed in said arm, a second follower attached to said bracket and received in said second slot to help guide said arm as said lid is moved between said closed and open positions, a cam mounted on said bracket to rotate about a predetermined axis and having a peripheral surface, a spring connected between said bracket and said cam and loaded to bias said cam in a first direction about said axis when said lid is in said closed position, an elongated flexible element having one end connected to said first follower and having an opposite end connected to said cam at a point spaced radially from said axis, said flexible element preventing said cam from being rotated in said first direction by said spring when said lid is in said closed position and wrapping around the peripheral surface of said cam when the latter rotates in said first direction as said lid is released from said closed position for movement toward said open position.

5. A hinge as defined in claim 4 further including a pin supported to rotate by said bracket, said cam being rotatable on said pin, said spring comprising a spiral spring having one end portion anchored to said pin and having an opposite end portion anchored to said cam, means for adjusting the load on said spring, said adjusting means comprising a worm gear rotatable with said pin, and a worm rotatably supported by said bracket and meshing with said worm gear, said worm and worm gear being operable to turn said pin in response to turning of said worm.

6. A hinge as defined in claim 5 in which said first slot is formed with a substantially straight and horizontal rear portion and with an upwardly curved forward portion, said second slot having a concavely curved lower edge which faces upwardly when said lid is in said closed position.

* * * * *